United States Patent [19]

Hara et al.

[11] Patent Number: 5,003,896

[45] Date of Patent: Apr. 2, 1991

[54] DEVICE FOR GUIDING A LOWER THREAD IN A SEWING MACHINE

[75] Inventors: Kazumasa Hara; Yasuro Sano; Mikio Koike; Mitsuru Nishijima, all of Tokyo, Japan

[73] Assignee: Janome Sewing Machine Co. Ltd., Tokyo, Japan

[21] Appl. No.: 286,383

[22] Filed: Dec. 16, 1988

[30] Foreign Application Priority Data

Dec. 18, 1987 [JP] Japan ..... 62-191381[U]

[51] Int. Cl.[5] ..... D05B 19/00; D05B 3/02; D05B 57/08

[52] U.S. Cl. ..... 112/121.11; 112/184; 112/453

[58] Field of Search ..... 112/121.11, 184, 242, 112/443, 453, 459

[56] References Cited

U.S. PATENT DOCUMENTS 4,340,003 7/1982 Hanyu et al. ..... 112/184
4,702,185 10/1987 Hanyu et al. ..... 112/453 X
4,784,073 11/1988 Hanyu et al. ..... 112/453

*Primary Examiner*—Wm. Carter Reynolds
*Attorney, Agent, or Firm*—Michael J. Striker

[57] ABSTRACT

A device for guiding a lower thread in a zigzag stitching sewing machine is provided with a lower thread guiding unit that determines two lower thread drawing positions in accordance with a selected pattern. The lower thread guiding unit includes a lower thread guiding part which, at one of the two positions, acts on the lower thread to guide a lower thread drawing position to a center of a needle amplitude. A lower thread releasing element, at the other of the two positions, cooperates with the lower thread guiding unit to release the lower thread engaged with the lower thread guiding part.

1 Claim, 11 Drawing Sheets

A
B
C
1
18a
19
19a
28
32
32a
33
34
35
35a
36
36a
37
38
39
40
48
48a
48b
48c
48d
48e
49
50
51
52
52a
52b
53
53a
53b
54
54a
55
57
57a

A
B
C
1
3
18a
19
19a
28
32
32a
33
34
35
35a
36
36a
37
38
39
40
48
48a
48b
49
50
51
52
52a
52b
53
53a
53b
54
54a
55
57
57a

4 : Pattern selecting means
56 : Memory of pattern forming information
57 : Discriminating means for pattern sorts
59 : Central processing unit
14 : Stepping motor for needle bar amplitude
25 : Stepping motor for feed adjustment
54 : Stepping motor for adjusting lower thread
61 : Memory of selected patterns

DEVICE FOR GUIDING A LOWER THREAD IN A SEWING MACHINE

FIELD OF THE INVENTION

The present invention relates to a device for guiding a lower thread in response to selection of patterns in a sewing machine which may select straight stitchings and zigzag stitchings.

BACKGROUND OF THE INVENTION

Straight stitches in a lock stitching are divided into normal stitches and hitch stitches. If those are mixed, the stitches are disoriented. In general, it is therefore desirable to carry out stitchings with the normal stitches only which do not cause untwistings of a stitched thread.

The straight stitches and the hitch stitches are formed in dependence upon whether a needle drops at a left side or a right side of the stitching direction with respect to the lower thread drawn from a loop taker.

When a hook of the loop taker 28 is positioned before the lower thread drawing point seen from the stitching forward direction, that is, when the lower thread is positioned at the left side of the needle, the straight stitches are formed. Reversely, when the hook is positioned after the lower thread drawing point, that is, when the lower thread is positioned at the right side of the needle, the hitch stitches are formed.

Therefore, in order to provide for forming straight stitches the lower thread is supplied at the left side, and the hitch stitches are prevented thereby.

However, depending upon this practice in the zigzag stitching, the lower thread is biased, especially when the stitching pitches are made small. In order to prevent such cases and form stitches without biasing, it is necessary in the prior art that the lower thread drawing point is, determined at the center in the amplitude of the zigzag stitching.

As shown in FIG. 16, if the lower thread 40 is positioned on the left side of the needle from a view of a machine operator, the loop taker is rotated counterclockwise as shown by an arrow, and catches a needle thread loop formed on the right side of the lower thread and locks the needle (upper) thread to the lower thread through a stitch formation phases shown in FIG. 16 (*a*)–(*g*). As the result, the straight stitch is formed. When the lower thread is positioned on the right side of the needle as shown in FIG. 17, the loop taker is rotated to catch a needle thread loop formed on the left side of the lower thread and locks the needle thread to the lower thread through a stitch formation phases shown in FIG. 17(*a*)–(*g*). As the result, the hitch stitch is formed.

As particularly shown in FIG. 19*a*, the lower thread is supplied to the left end L of the laterally elongated needle dropping hole from a position opposite to the needle hole and leftward of the left end L of the needle hole, because the straight stitches are generally formed with a needle position set adjacent to the left end L of the laterally elongated needle hole 18*a* within which the needle is laterally swingable from minimum to maximum for zigzag stitches. The needle position adjacent to the left end L of the needle hole is so set as to reduce the up and down movements of a fabric which may otherwise be caused as the needle penetrates into and out of the fabric to be sewn.

However with reference to FIG. 15(*a*), in case of zigzag stitching, the needle is swingable between the opposite needle positions L and R over a distance D. It is therefore observed that the required amount of lower thread is different depending upon the needle positions L and R. Much more amount of lower thread is required when the needle come to the right end needle position R. The thread tension due to drawing out an additional amount of lower thread will pull the needle thread down onto the underside of the fabric to be sewn.

To prevent the lower thread from biasing and hitch stitching, the lower thread drawing opening is made different in the straight stitching and the zigzag stitching.

Laid open Japanese utility model No. 23,074/81 assigned to the assignee of the present application discloses that, with respect to a sewing machine having the lower thread drawing opening at an amplitude center, a member moving the lower thread drawing open to the left side of the needle for carrying out the straight stitching, is connected to a pattern selecting member for guiding the lower thread to the left side.

In conventional devices the guide member is moved laterally for selecting the patterns so as to make the guide member act directly on the lower thread and guide the lower thread drawing open. This is excellent in clearly switching the lower thread drawing open. When a guide of a lower thread is released, the lower thread is bent and is slackened by a guided amount, and if this amount is absorbed when consecutive stitches are formed, the slackening is cancelled from the thread. But due to the slackening of the thread, the stitches just after having changed the pattern is sometimes to disoriented.

SUMMARY OF THE INVENTION

It is an object of the invention to provide a device for guiding the lower thread, which determines different conditions for the lower thread when the straight stitching or the zigzag stitching is selected, that is, which sets a lower thread drawing position to agree to a selected pattern, and does not make the thread slackened.

The object of the invention is achieved by providing in the zigzag stitching sewing machine comprising stitch forming means including a needle and a needle thread catching means cooperating with the needle and reciprocating vertically and laterally; a pattern forming means for controlling said lateral reciprocation of the needle; and means for selecting a desired pattern from stored patterns a lower thread guiding device comprising lower thread guiding means which is connected to the pattern selecting means and determines lower thread drawing positions at two positions in response to the selected pattern. The lower thread guiding means in one of its two positions, causes a lower thread guiding part to act on the lower thread so as to guide the lower thread drawing position to a center of the needle amplitude.

The thread releasing means in the other position, associates with the lower thread guiding means so as to release the lower thread engaged with the lower thread guiding part.

The pattern selecting means is operated to select a desired pattern, and the lower thread guide means is actuated in response to a sort of the selected pattern such as a zigzag stitch other than the straight stitch.

The present invention as to its construction so to its mode of operation, together with additional objects and advantages thereof, will be best understood from the following description of the preferred embodiments with reference to the appended drawings.

DETAILED DESCRIPTION OF PREFERRED EMBODIMENTS OF THE INVENTION

Figure 9:
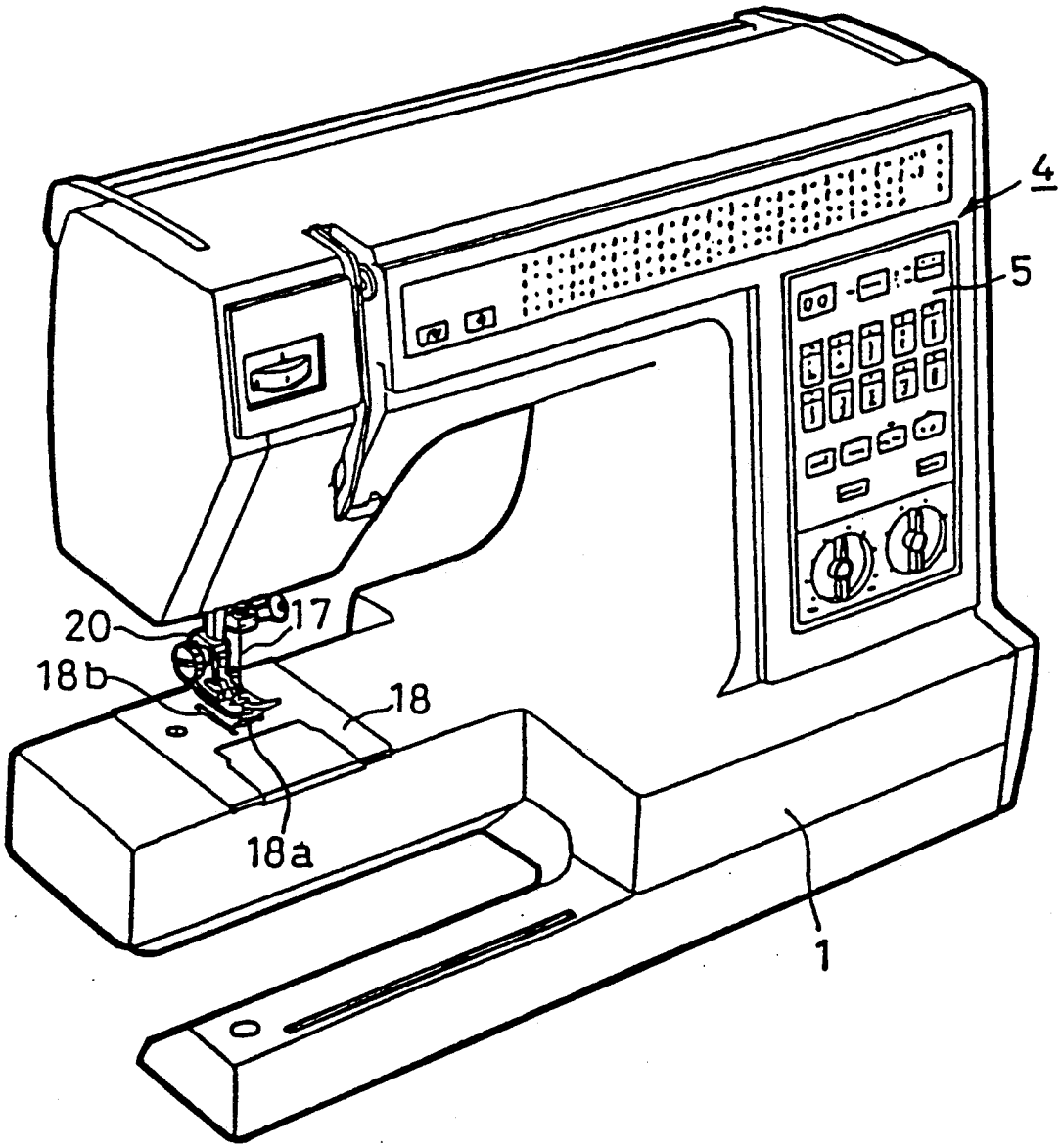
FIG. 9 is a perspective view of a sewing machine in which the lower thread adjusting device according to the invention is used.

FIG. 9 shows the outer perspective view of the sewing machine and a machine frame 1 is attached with a key board 5 of a pattern selecting means 4 for selecting a desired pattern from many stored patterns.

Figure 10:
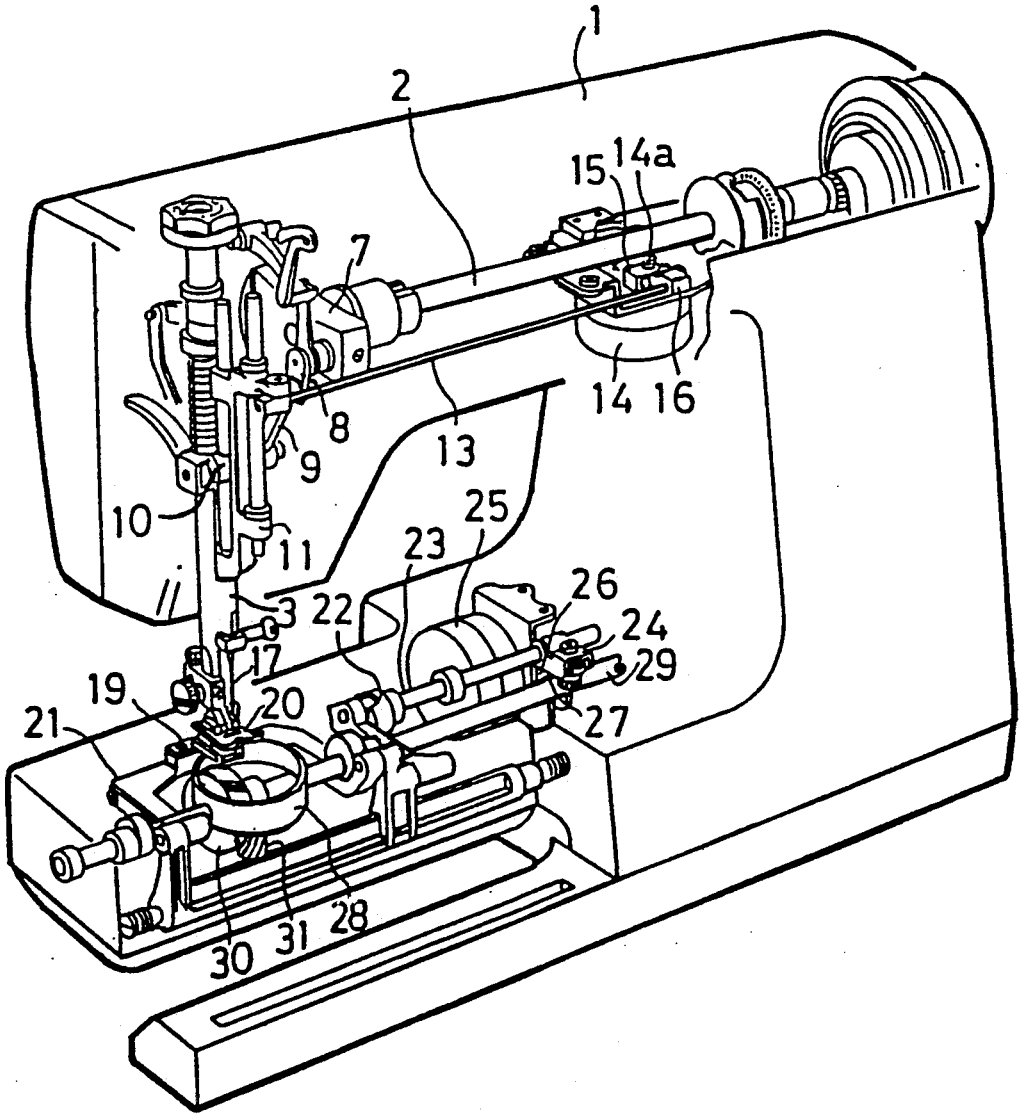
FIG. 10 is a perspective view a mechanism of the sewing machine shown in FIG. 9.

FIG. 10 shows that a needle bar 3 is mounted on the machine frame 1 and is vertically movable in connection with an upper shaft 2 which is rotationally mounted (journalled) on the machine frame. Namely as generally known, the needle bar 3 is slidably inserted into a needle bar support 11 and is fixedly connected to a needle holder 10 which is connected to a needle bar crank 8 through a crank rod 9. The crank 8 is operatively connected to a balance weight 7 secured to one end of the upper shaft 2 for rotation therewith. The needle bar supporter 11 is swingably mounted on a vertical shaft 12 secured to the machine frame 1, and is prevented from vertical movement. The needle bar support 11 is connected to one end of a rod 13 which has the other end connected to an arm 15 secured on an output shaft 14*a* of a stepping motor 14 for controlling the needle position.

A feed dog 19 is mounted on a horizontal feed arm 21 to be driven by the drive shaft 2. The movement of the horizontal feed arm 21 is adjusted by adjusting the angular position of a member 22 fixed to one end of an adjusting shaft 23 which has the other end secured to an arm 24 connected to a crank 26 mounted on the output shaft of a feed control stepping motor 25 by way of an crank 26 and a link 27.

A loop taker 28 serving as the needle thread catching means is rotatably supported to the machine frame 1 under the needle plate 18, and a gear 30 is in mesh with a gear 31, the former being secured on a lower shaft 29 to be rotated in synchronism with the needle bar 3 by the upper shaft 29, and the latter being of the loop taker 28 secured integrally to the lower part thereof.

The lower thread adjusting device will be explained.

Figures 1, 2:
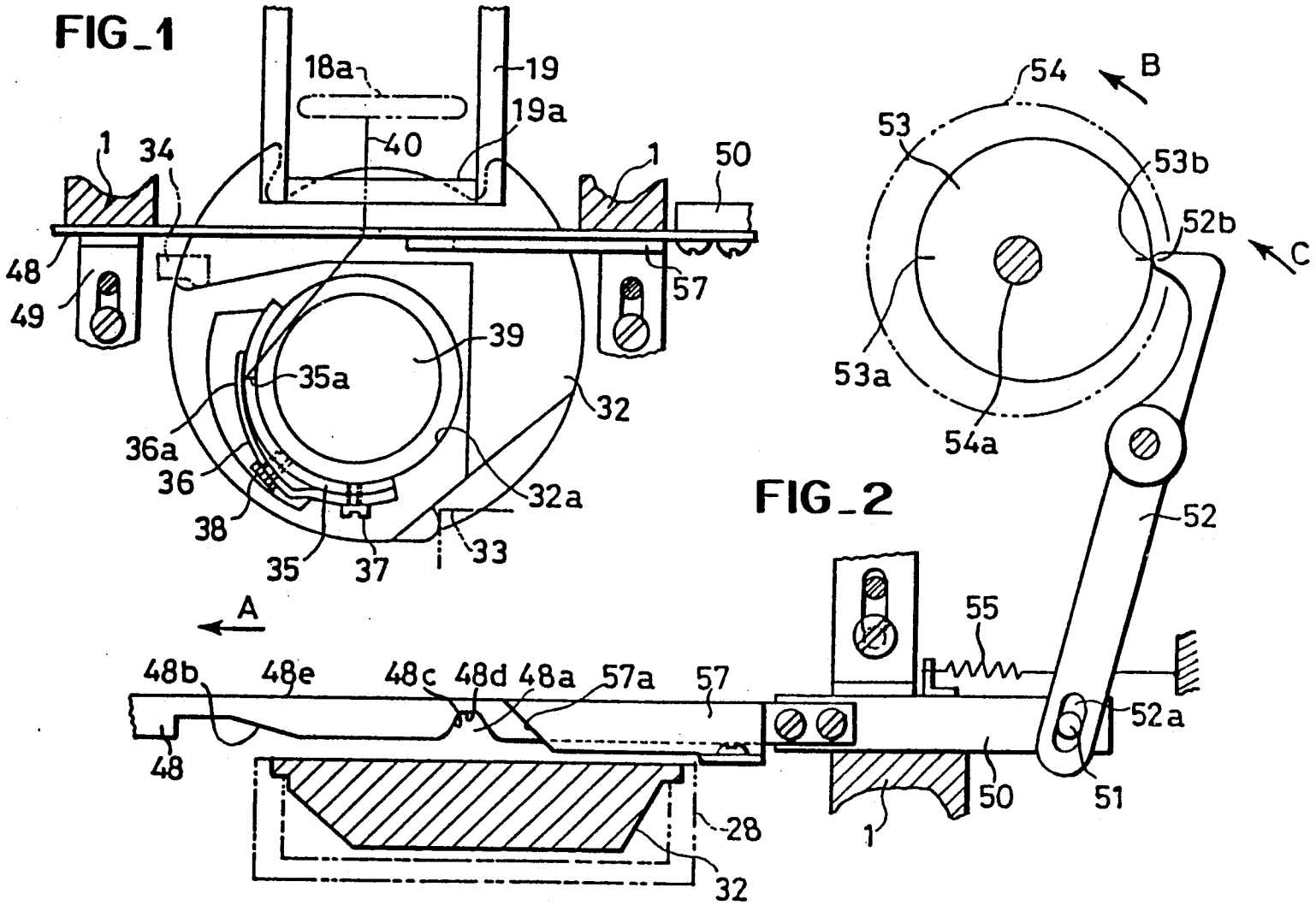
FIG. 1 is a plan view of the lower thread adjusting device of the invention.
FIG. 2 is a partially plan view of the lower thread adjusting device shown in FIG. 1.
Figure 3:
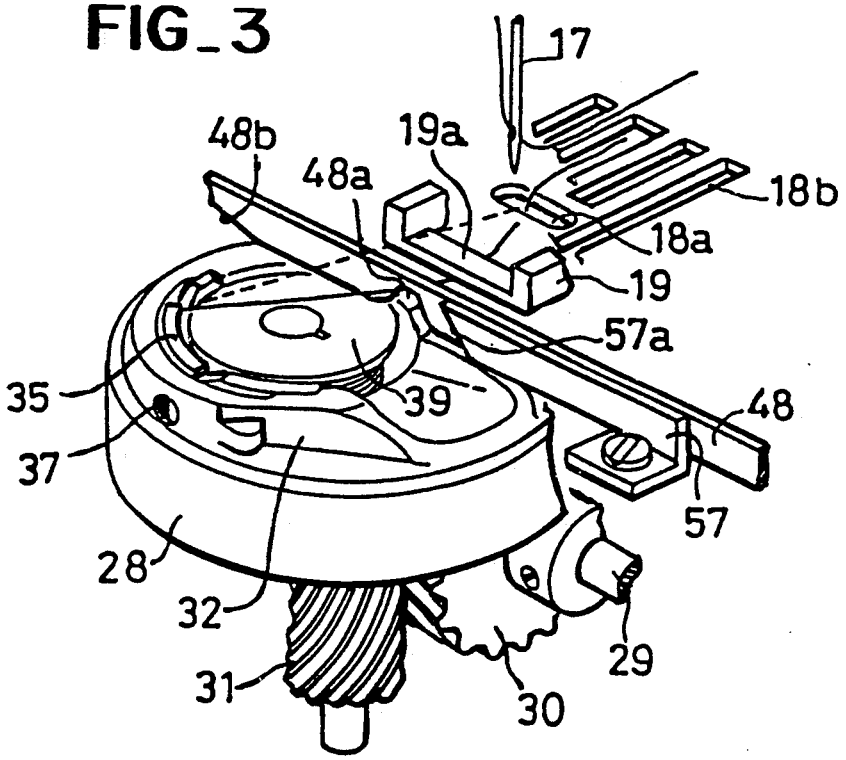
FIG. 3 is a perspective view of the lower thread adjusting device.

FIGS. 1 and 2 show that a bobbin carrier 32 is rotatably supported within a loop taker 28. The bobbin carrier 32 contacts rotation checkers 33 and 34 secured to the machine frame 1, and is restrained from rotation. A lower thread drawing frame 35 having a lower thread drawing opening 35*a* is fixed on an outer circumference of a bobbin housing 32*a* provided in the bobbin carrier 32. A lower thread tension spring 36 comprises a thin sheet and is secured to the frame 35 at its one end by a screw 37. An end 36*a* of the tension spring 36 positions on a slit of the opening 35*a*, and the spring 36 is formed with a hole at its center for inserting a head screw 38.

The head screw 38 passes through the hole of the spring 36 and screws into a hole of the lower thread drawing frame 35, and the head screw 38 presses the spring 36 with its head so as to adjust a pressure exerted between the end 36*a* of the tension spring 36 and the lower thread drawing opening 35*a*.

A bobbin 39 with the lower thread 40 is rotatably fitted in the bobbin housing 32*a* of the bobbin carrier 32. The lower thread 40 is drawn from the opening 35*a* through a thread guiding slit formed in the lower thread drawing frame 35, and is effected with tension by the pressure of the lower thread spring 36, so that it is drawn toward the fabric from a needle hole 18*a* of the needle plate 18 (see FIG. 9).

An actuating lever 48 has a space above the bobbin carrier 32, formed with a plate in parallel to the amplitude direction of the needle 17 between the thread drawing hole 35*a* and the needle hole 18*a*, pressed by a pressing piece 49, supported by the machine frame 1, and movably supported along the arrow A, i.e., the amplitude direction of the needle. The actuating lever 48 is formed with a cutout 48*a* at the center thereof.

The actuating lever 48 is fixed at its one end with an end of an actuating body 50 supported by the machine frame 1 slidably in the arrow A and in opposition thereto along the length of the oblong hole 32. The lever 48 has a pin 51 at its other end, which passes movably through a hole 52*a* formed in one end of of actuating pawl 52.

A cam 53 is secured on an output shaft 54*a* of a stepping motor 54 fixed to the machine frame 1 for adjusting the lower thread, and is defined with an operative part 53*a* and an inoperative part 53*b* on its outer circumference. The inoperative part 53*b* is formed in a large diameter part of the cam 53 with respect to the output shaft 54*a*, and the operative part 53*a* is formed in a small diameter part with respect to the center of the output shaft 54*a*.

The actuating pawl 52 has a pawl portion 52*b* at its one end, and is connected with the actuating body 50. A spring 55 is connected at its one end with the actuating body 50 and is at its other end with the machine frame 1, so that the actuating pawl 52 is rotated in an arrow C via the pin 51, and the pawl portion 52*b* contacts the cam 53.

Figure 11:
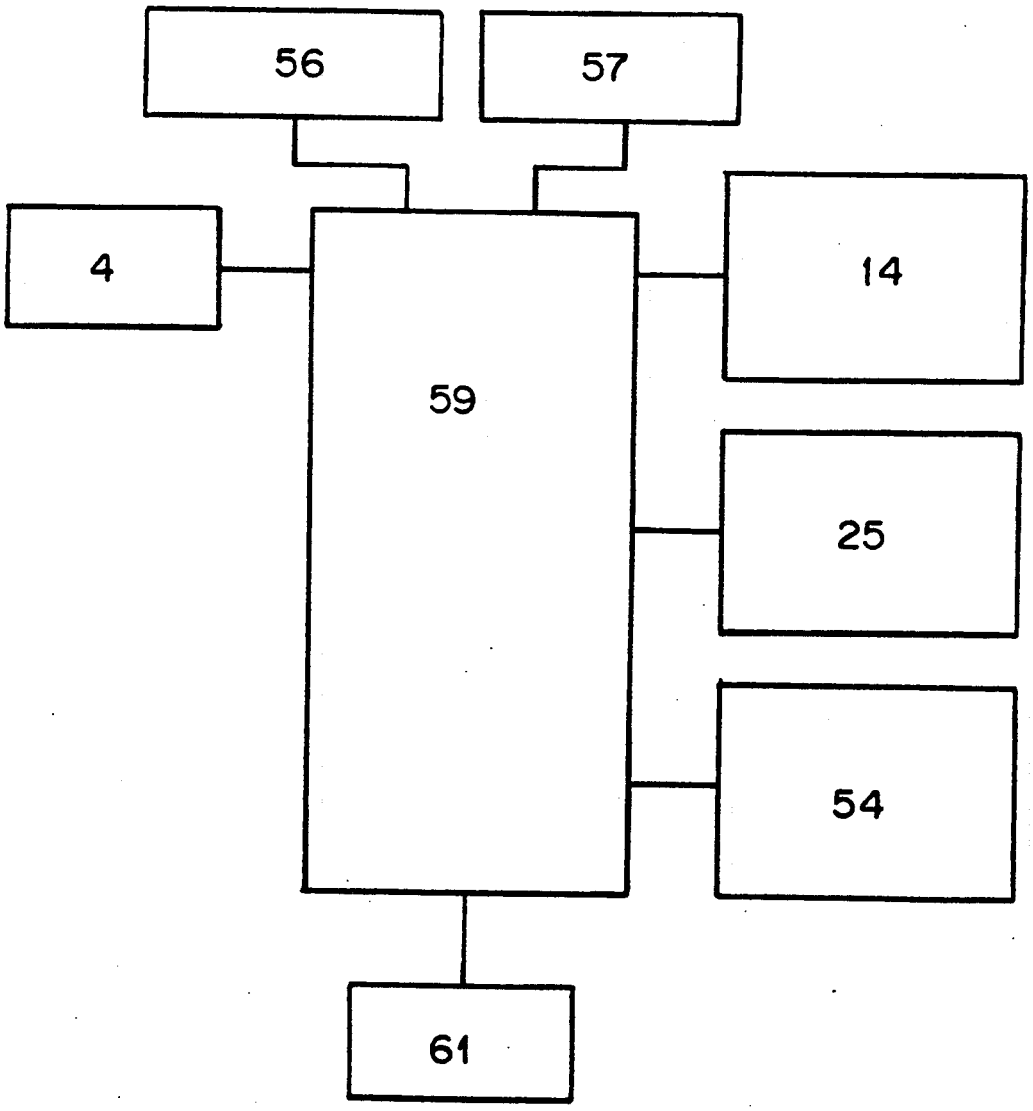
FIG. 11 is a block diagram for operating the present device.

FIG. 11 is a control block diagram where a reference numeral 4 is a pattern selecting means, 56 is memory of an pattern forming information, and 57 is a disriminating sorts of the patterns. These means are connected to a central processing unit 59.

At the left part of the cutout 48*a* of the actuating lever 48, a guiding wall 48*b* is defined which goes upward from the lower side to the upper side of the lever 48.

A lower thread releasing means 57 is secured to the machine frame 1 at its one end, and its standing part is parallel to the actuating lever 48 and its end is formed with a releasing wall 57*a* standing at its lower side.

An explanation will be made to actuations of the lower thread adjusting device composed as stated above.

A key board 5 of the pattern selecting means 4 is operated to select a desired pattern. Pattern forming information and pattern code are read out from the pattern forming information memory 56, and stored in the selected pattern memory 61. The pattern code discriminates whether or not the selected pattern is a straight stitching, and the straight stitching is assigned with "1", and other patterns are assigned with "0".

A reference will be made to a case that a selected pattern is other than the straight stitching.

A pattern forming information and a pattern code are read out from the pattern forming information memory 56 by the selecting operation and are stored in the memory 61.

If the pattern code is "0", the discriminating means 57 outputs to the central processing unit 59 a signal of "the pattern is other than the straight stitching, and the lower thread adjust means should be set to the pattern stitching condition".

With respect to the above output, the stepping motor 54 for adjusting the lower thread is rotated in the direction arrow B to position from FIGS. 1 to 4 where the inoperative part 53*b* of the cam 53 contacts the pawl portion 52*b* of the actuating pawl 52. Since the inoperative part 53*b* is at the maximum biasing position with prespect to the output shaft 54*a* of the stepping motor 54, the pawl 52 is rotated in a direction opposite to that of the arrow C, and the actuating body 50 and the actuating lever 48 are moved in the direction of arrow A against the biasing of the spring 55 via the pin 51 engaging in the hole 52*a*. By the movement of the actuating lever 48, the right side of the cutout 48*a* moves.

The cutout 48*a* is positioned at almost the center of the needle amplitude range, and the left side wall 48*c* acts on the lower thread 40 so as to bring the thread drawing position to almost the center of the needle amplitude range for preventing the lower thread from biasing in the zigzag stitching and so on.

Figure 4:
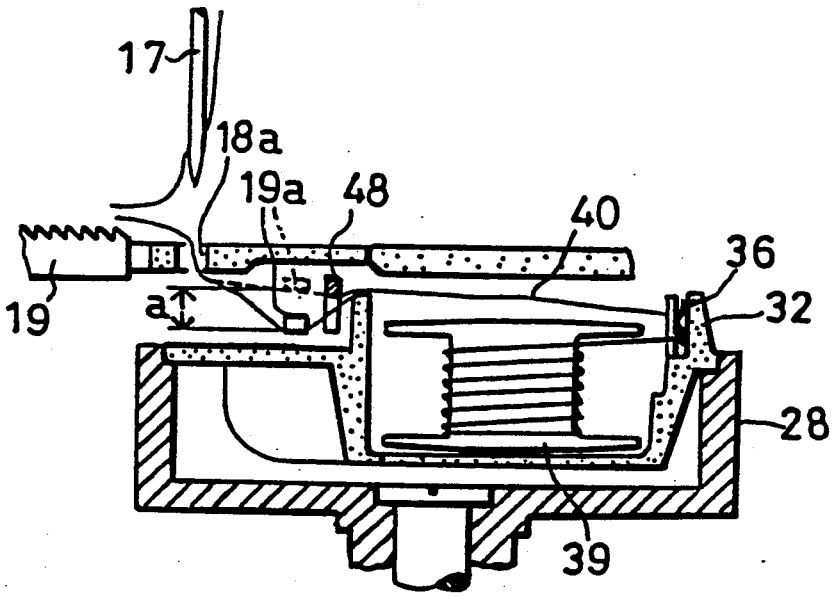
FIG. 4 is a partially cross sectional view of a bobbin carrier.

Since the upper end 48*d* of the cutout 48*a* is formed at the upper part of the lever 48 to approach the upper side 48*e*, the lower thread 40 is, as seen in FIG. 4, guided beneath of the upper end 48*d* of the cutout 48*a* and is further guided to a needle hole 18*a* of the needle plate 18 via the lower side of a bridge 19*a* of the feed dog 19.

The bridge 19*a* is moved vertically between an upper position of the dotted line and a lower position of the solid line in FIG. 4. Since the upper end of the cutout 48*a* is positioned above or substantially on a line combining the lower surface of the bridge 19*a* in its upper position and the upper edge of the bobbin carrier 32, the lower thread 40 is in contact with the lower surface of the bridge 19*a* while the bridge is moved up and down as defined by a distance "a" by about 5 mm. Thus, the lower thread of so defined amount is drawn out from the bobbin 39 and is supplied to the stitch in accordance with the by vertically reciprocating the bridge 19*a* between upper and lower positions shown in FIG. 4 with dotted and solid lines, respectively. The distance a between the upper and lower positions is about 5 mm pattern such as zigzag stitching.

Further explanation will be made to a case that the selected pattern is a straight stitching.

Since the pattern code is "1", the pattern sort discriminating means 57 outputs to the central processing unit 59 a signal of "the pattern is a straight stitching and the lower thread adjusting means is set to the straight stitching condition".

With respect to the above output, the stepping motor 54 for adjusting the lower thread is rotated in the arrow B to a dotted line position of FIGS. 5 to 8 where the projection 53*c* of the cam 53 contacts the pawl portion 52*b* of the actuating pawl 52. Since the operative part 53*a* is at the minimum biasing position with respect to the output shaft 54*a* of the stepping motor 54, the pawl 52 is rotated in the direction of arrow C, and the actuating body 50 and the actuating lever 48 are moved in a direction opposite to that of arrow A by the biasing of the spring 55 via the pin 51 engaging in the hole 52*a*.

When the actuating lever 48 is moved in this opposite direction of the cutout 48*a*, the lower thread 40 held by the cutout 48*a* also moves in the direction opposite to that of the arrow A and contacts a releasing wall 57*a* of the lower thread releasing means 57. The lower thread is moved by moving the lever 48 along the obliquity of the releasing wall 57*a* in a direction opposite to that of the arrow A.

Since the lower end of the releasing wall 57*a* is provided under the lower end of the actuating lever 48, the lower thread 40 guided along the obliquity reaches below than the lower end of the actuating lever 48.

The lower thread separated from the cutout is moved in a direction opposite to that of the arrow A, and is guided along the obliquity 48*b* formed from the left lower side of the lever 48 to its left upper side. Therefore the hitch stitches are avoided when the straight stitching is carried out, and the perfect stitches are formed.

Figure 8:
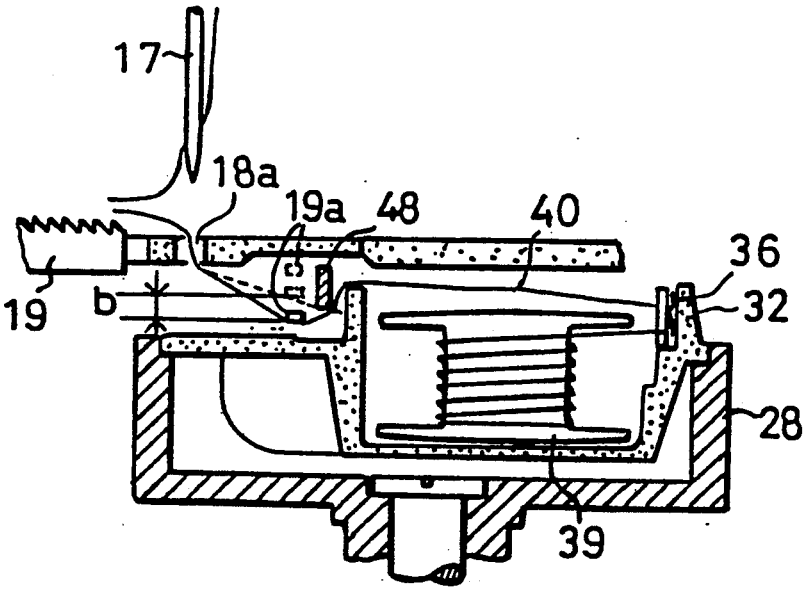
FIG. 8 is a partially cross sectional view of a part of the bobbin carrier.

Since the position where the lower thread contacts the obliquity 48*b* is, as seen in FIG. 8, below the lower thread running path between the upper surface of the bobbin carrier 28 and the bridge 19*a* of the feed dog 19, the bridge 19*a* does not contact the lower thread at the upper position of the bridge 19*a* but contacts the lower thread at the center position between the upper position and the lower position as shown with the one-dotted line for drawing out the lower thread by vertically reciprocating by amount b that is, about 2.5 mm between the central position and the lower position, so that the lower thread is less supplied in accordance with the straight stitching.

Figure 12:
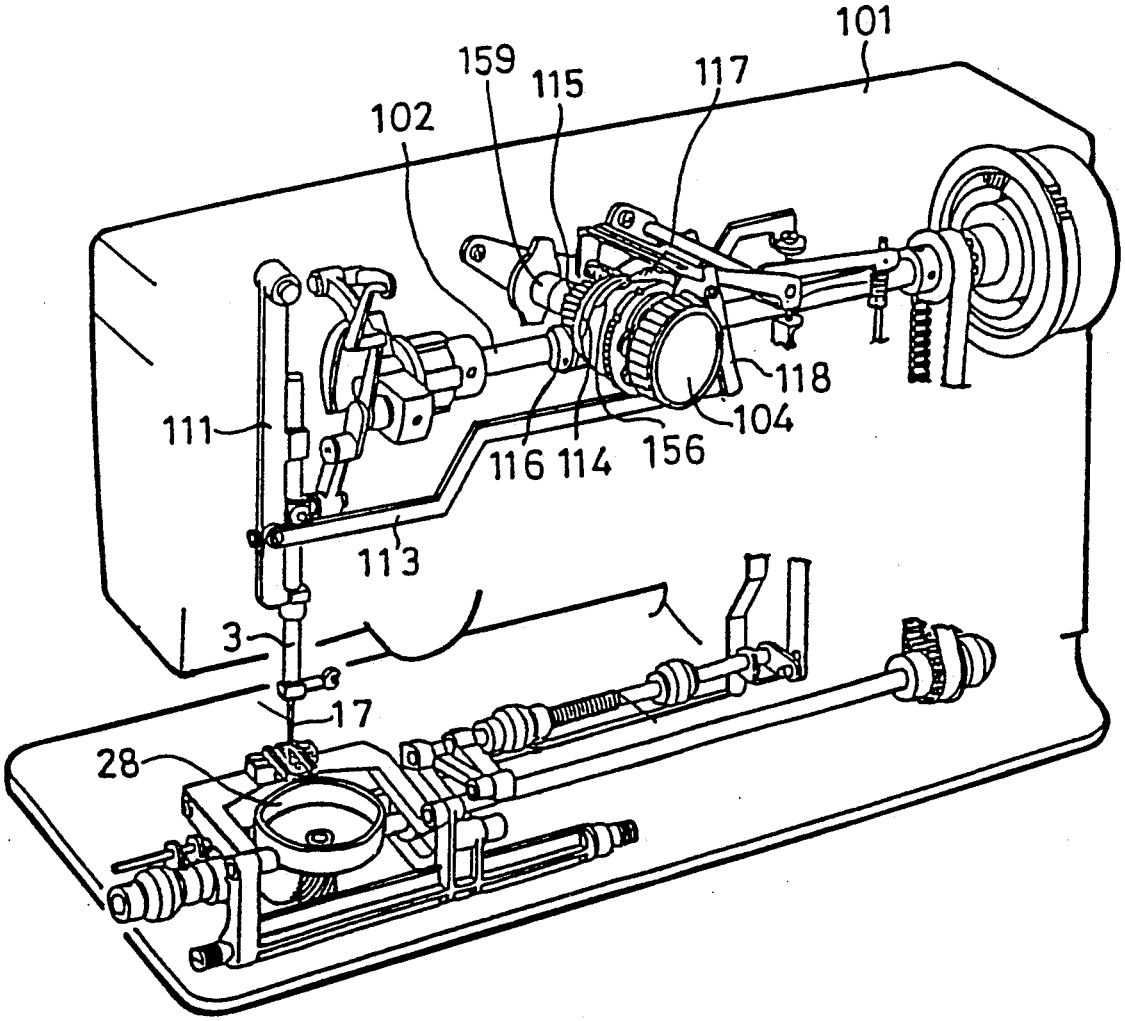
FIG. 12 shows a perspective of another embodiment of a mechanism of a sewing machine incorporating a lower thread adjusting device of the invention.
Figure 13:
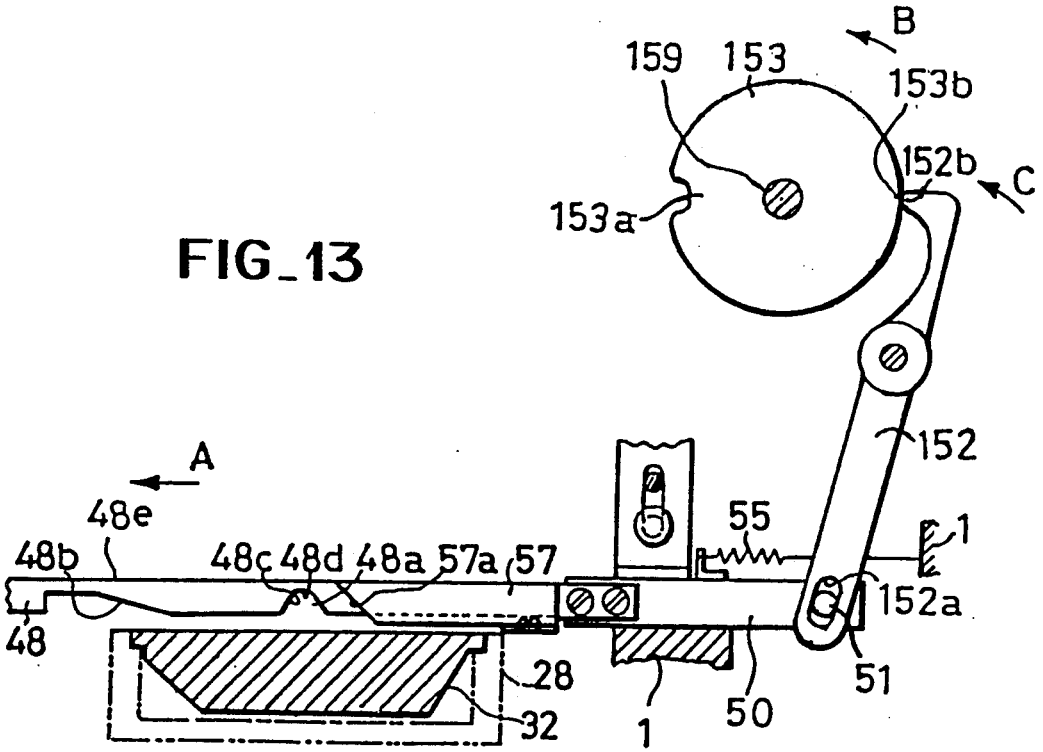
FIG. 13 is a partially cross-sectional view of a lower thread adjusting device of the mechanism shown in FIG. 12.
Figure 14:
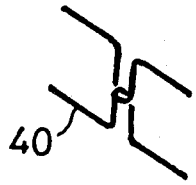
FIG. 14 is a view showing straight stitching.
Figure 15:
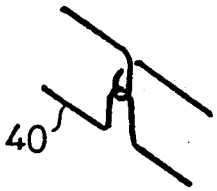
FIG. 15 is a view showing hitch stitching.
Figure 18:
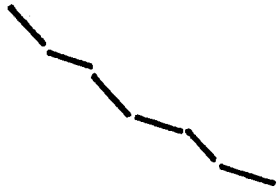
FIG. 18 is a view of a disorder of stitches.
Figure 20:
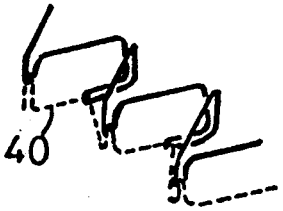
FIG. 20 is a view showing stitches biased by the lower thread in the zigzag stitching.
Figure 21:
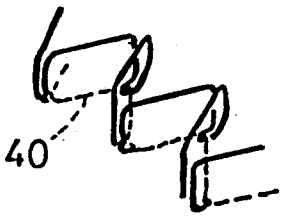
FIG. 21 is a view showing stitches formed without causing biasing of the lower thread.
Figure 19A:
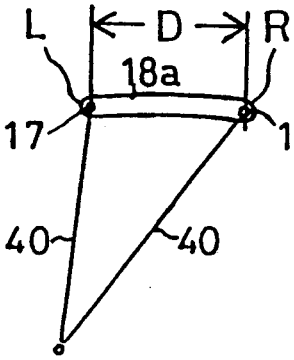
FIG. 19 is a view showing drawings out the lower thread.
Figure 19B:
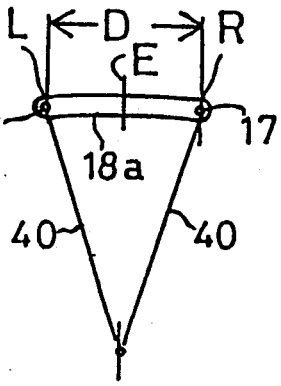
Figures 16A, 16B, 16C, 16D, 16E, 16F, 16G:
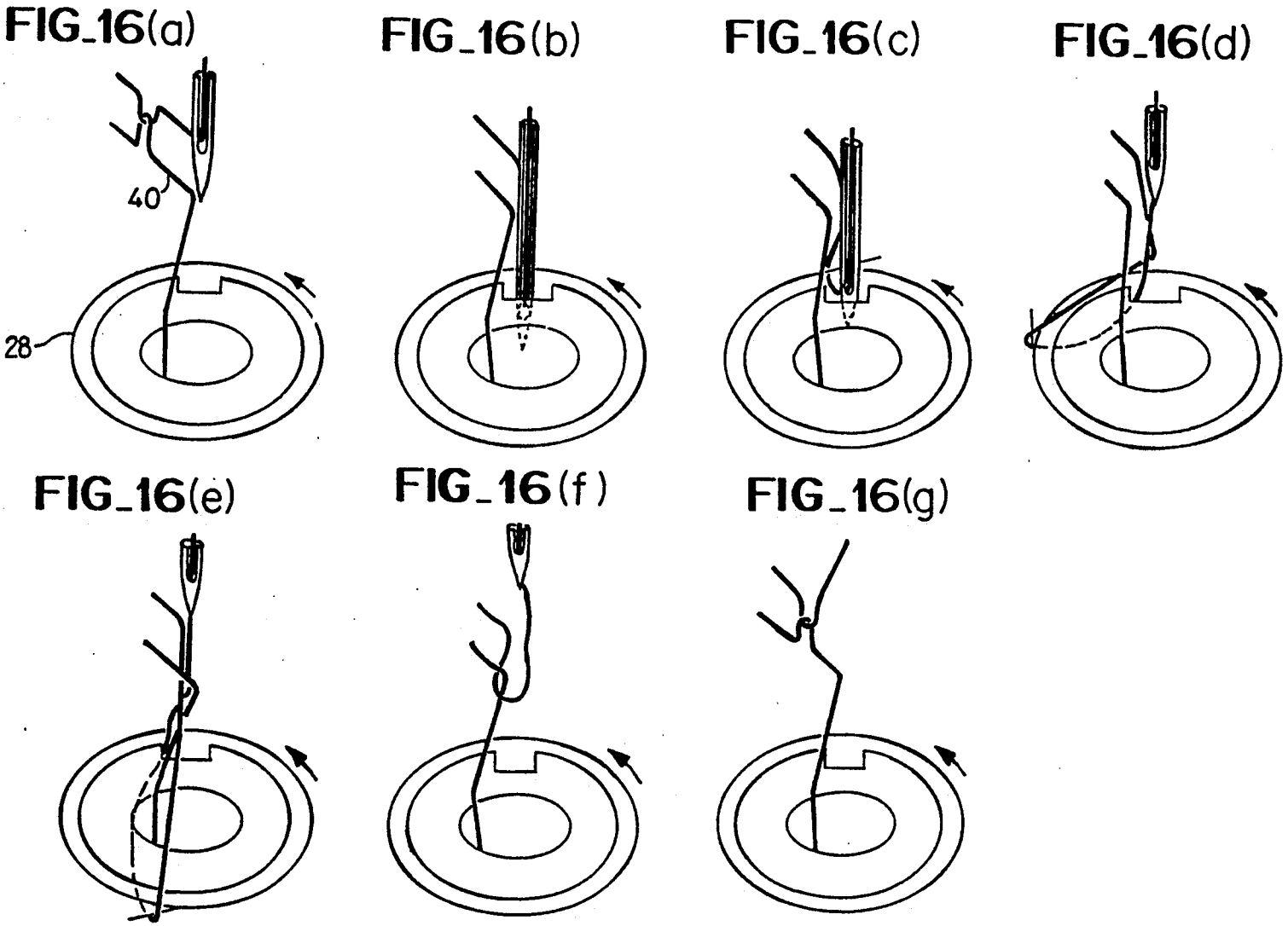
FIG. 16 is a diagram of forming straight stitches.
Figure 17A:
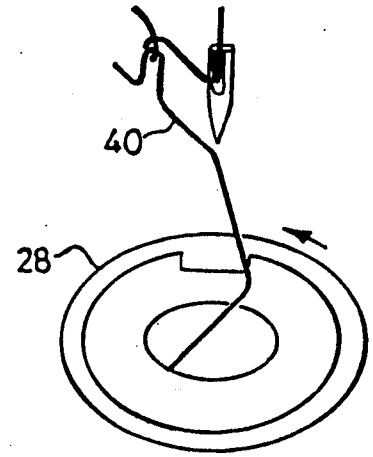
FIG. 17 is a diagram of forming hitch stitches.
Figure 17B:
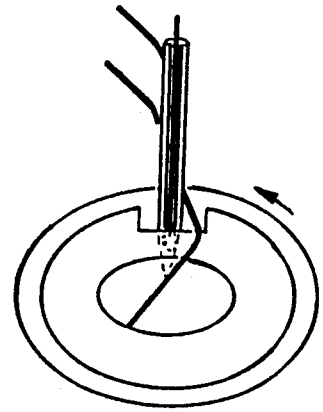
Figure 17C:
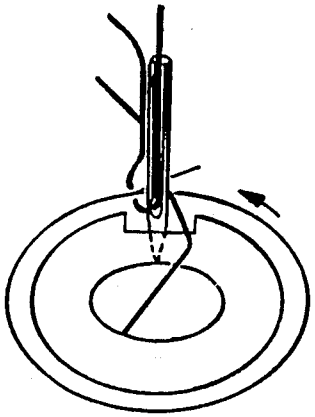
Figure 17D:
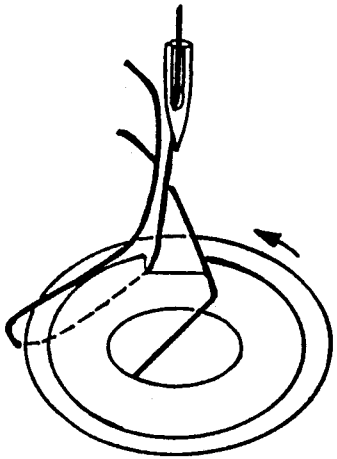
Figure 17E:
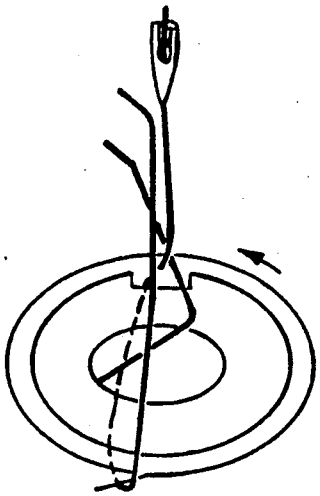
Figure 17F:
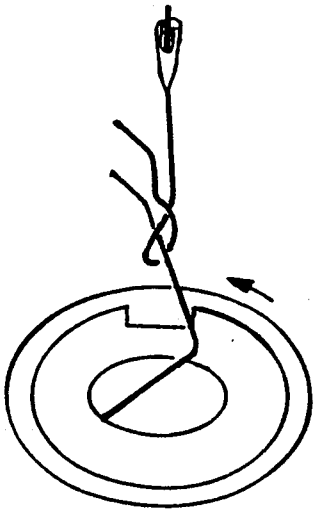
Figure 17G:
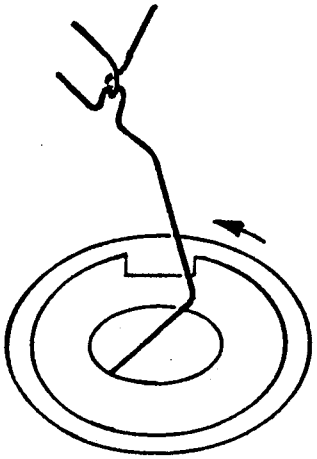

The other embodiment will be explained, where the present device is attached to a mechanical sewing machine as shown in FIGS. 12 and 13.

In FIG. 12, a pattern selecting dial 104 is provided at the outside of a dial shaft 159 rotatably pivoted to a machine frame 101. A pattern cam 114 of a needle bar amplitude of a memory storing pattern forming informations, is fixedly mounted on a cam shaft (not shown) rotatably supported to the machine frame 101 together with a feed adjusting cam (not shown).

A gear 115 is mounted on the stated cam shaft, and is in mesh with a worm 116 secured on an upper shaft 102 pivoted rotatably to the machine frame 101.

The pattern cam 114 is followed by a pawl 117 which is connected at its one end with a rod 113 via a transmission means 118, and the rod 113 is connected at its other end with a needle bar supporter 111.

The dial shaft 159 is secured with a lower thread adjusting cam 153 and a known cam 156 which guides the pawl 117 following the pattern cam 114 and selects one of the cams.

The lower thread adjusting cam 153 is, as seen in FIG. 13, formed with an operative part 153*a* being a small diameter part and. The other part of the outer circumference has a large diameter and is formed with an inactuating part 153*b*. The lower thread adjusting cam 153 is engaged with a pawl part 52*b* of the actuating pawl 52.

The structure of the lower thread adjusting means for the lower thread adjusting means is the same as the 1st embodiment and an explanation will be omitted.

When the pattern selecting dial 104 is operated to select the patterns as the zigzag stitching, the pawl part 52*b* of the pawl 52 contacts the inoperative part 153*b* of the lower thread adjusting cam 153 and rotates in a direction opposite to that of the arrow C to the position shown in FIGS. 1 to 4. This position is the same as when the zigzag stitching is selected and the actuating lever 48 is moved in a direction of the arrow A. By moving the actuating lever 48, the cut-out 48*a* thereof is almost at the center of the needle amplitude, and the left side wall 48*c* acts on the lower thread 40 so as to set the lower thread drawing position almost at the center of the needle amplitude accordingly, and prevent the lower thread from biasing.

Since the upper end 48*d* of the cutout 48*a* is so formed as to approach the upper side of the actuating lever 48, the lower thread is, as shown in FIG. 4, contacted to the bridge 19*a*, irrespective of the upper and the lower positions of the bridge 19*a* of the feed dog 19, so that is it possible to draw the more amount of the lower thread in accordance with the upper and lower amounts a of the bridge 19*a* to satisfy the pattern stitchings.

When the straight stitching is selected by the dial 104, the pawl part 52*b* of the actuating pawl 52 contacts the actuating part 153*a* of the cam 153.

Figures 5, 6:
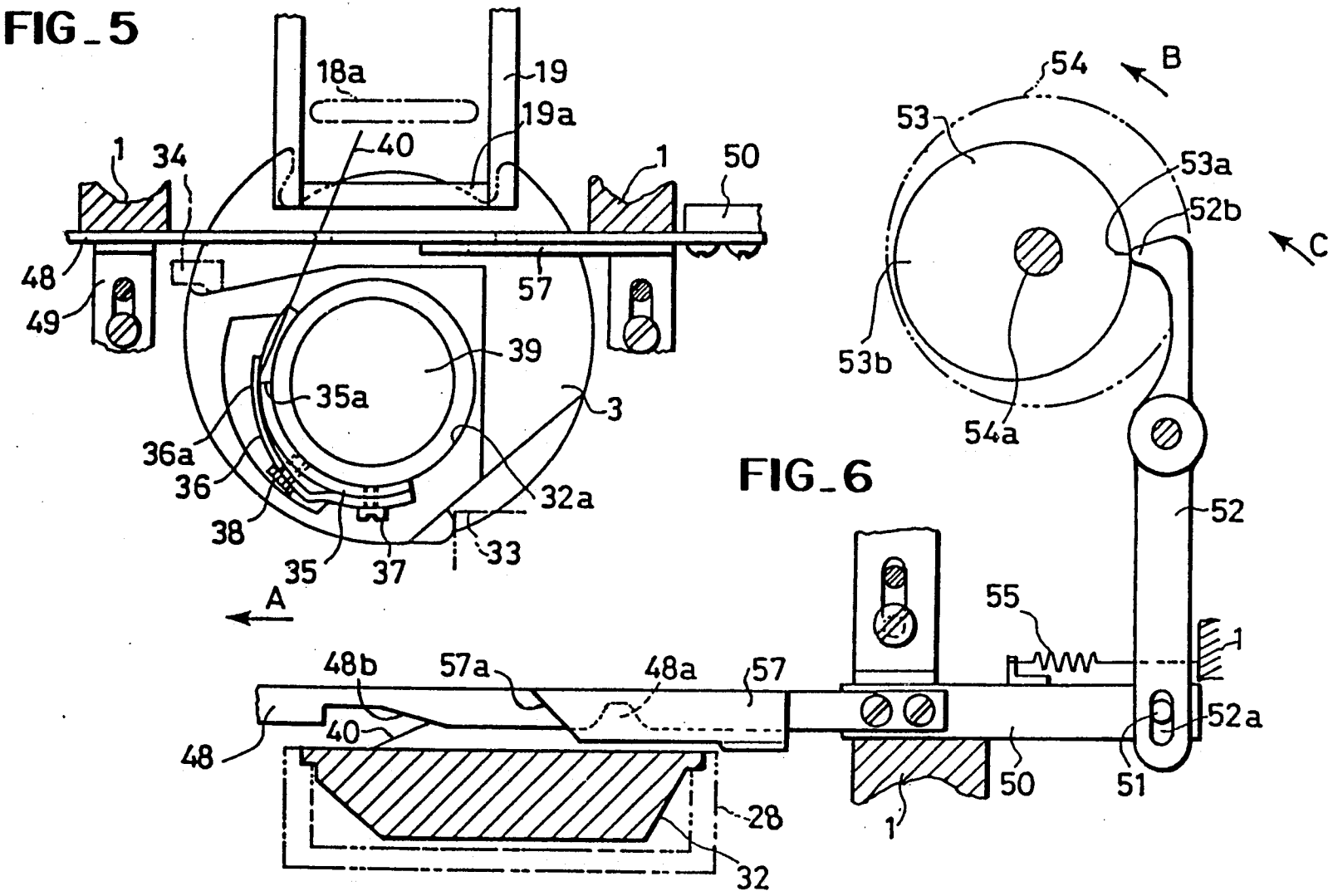
FIG. 5 is a plain view of the lower thread adjusting device in actuated position.
FIG. 6 is a partially cross-sectional view of the device shown in FIG. 5.
Figure 7:
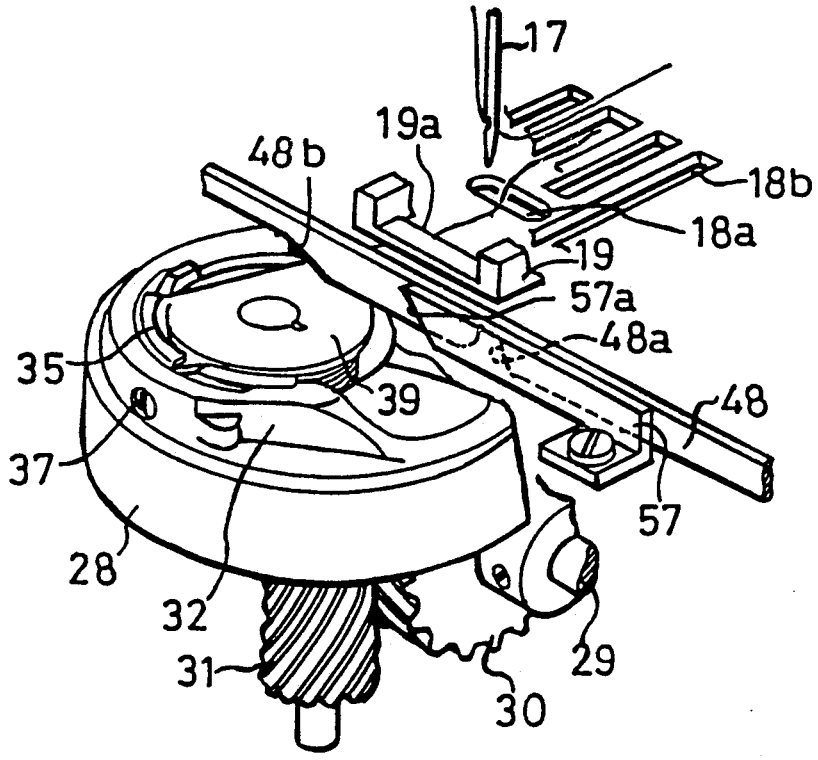
FIG. 7 is perspective view of the lower thread adjusting device of the invention during operation.

Therefore, when the pattern selecting dial 104 is operated to select the straight stitching from the patterns other than the straight stitching, the pawl 52 is largely rotated in the direction of the arrow C by the activating part 153*a* of the cam 153 to the position corresponding to the position shown in FIG. 5.

This position is the same as when the straight stitching is selected in the first embodiment, where the lever 48 is moved in opposition to the arrow A by the action of the spring 55.

When the cutout 48*a* of the actuating lever 48 moves in opposition to the arrow A, the lower thread supported in the cutout 48*a* also moves in opposition to the arrow A. The lower thread is guided on the oblique surface of a releasing wall 57*a* of the lower thread releasing means 57, and is released from the cutout 48*a* and is further guided on a left oblique surface 48*b* by the actuating lever 48 to the left than the leftmost position of the needle amplitude range.

Accordingly, the perfect stitches may be formed by preventing formation of the hitch stitches. Since the position where the lower thread is contacted on the oblique surface, is as shown in FIG. 8 lower than the lower thread running path between the upper surface of the bobbin carrier 28 and the bridge part 19*a* of the feed dog 19, the bridge part 19*a* does not contact the lower thread at an upper position thereof, but contacts it at a middle position between the upper and lower parts as shown with the one-dotted line, so that the lower thread is supplied in response to the upper and lower amounts b between the middle position and the lower position, and the thread is supplied in an less amount in accordance with the straight stitching.

While the invention has been illustrated and described as embodied in a device for guiding a lower thread in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for guiding a lower thread in a zigzag stitching sewing machine provided with stitch forming means comprising a vertically and laterally movable needle and needle thread catching means cooperating with said needle, a pattern forming means for controlling a lateral reciprocation of the needle, and means for selecting a desired pattern from stored patterns, said guiding device comprising a lower thread guiding means connected to the pattern selecting means of the sewing machine for determining first and second lower thread drawing positions in accordance with a selected pattern, said lower thread guiding means including a lower thread guiding part which, at one of said first and second positions, acts on the lower thread so as to guide a lower thread drawing position to a center of a needle amplitude; and a lower thread releasing means connectable, at the other of said first and second positions, with the lower thread guiding means so as to release the lower thread engaged with said lower thread guiding part.

* * * * *